US006730207B2

(12) United States Patent
Okamoto et al.

(10) Patent No.: US 6,730,207 B2
(45) Date of Patent: May 4, 2004

(54) METHOD OF MANUFACTURING PART FOR OPTICAL FIBER CONNECTOR

(75) Inventors: Shinichi Okamoto, Saitama (JP); Hisashi Ooshima, Tokyo (JP)

(73) Assignee: Hikari Tech Co., Ltd., Tokyo (JP)

( * ) Notice: Subject to any disclaimer, the term of this patent is extended or adjusted under 35 U.S.C. 154(b) by 222 days.

(21) Appl. No.: 09/993,254

(22) Filed: Nov. 19, 2001

(65) Prior Publication Data

US 2003/0094371 A1 May 22, 2003

(51) Int. Cl.[7] ..... C25D 1/02; C25D 1/00
(52) U.S. Cl. ..... 205/73; 205/67
(58) Field of Search ..... 205/67, 73

(56) References Cited

U.S. PATENT DOCUMENTS 4,290,857 A * 9/1981 Ikeda et al. ..... 205/73

* cited by examiner

*Primary Examiner*—Edna Wong
(74) *Attorney, Agent, or Firm*—Richard M. Goldberg

(57) ABSTRACT

A method of manufacturing a ferrule includes the steps of electroforming on a metallic wire used as a mother mold to produce an elongated cylindrical rod, by providing grooves on the circumferential surface of the rod, breaking the groove portion and drawing the wire, and machining the rod with respect to at least length and size (diameter), such that the method omits the step of sealing the wire with an electric insulator and an elongated electroformed rod can be manufactured and variation in sizes of diameter and off-center failure are decreased.

6 Claims, 5 Drawing Sheets

FIG. 1(a)(2)
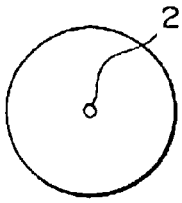
FIG. 1(a)(1)
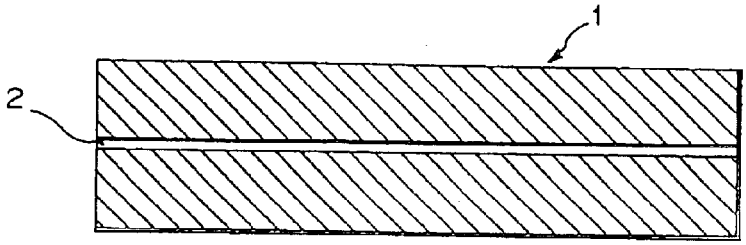
FIG. 1(b)(2)
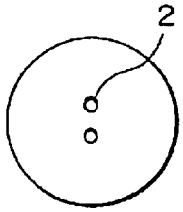
FIG. 1(b)(1)
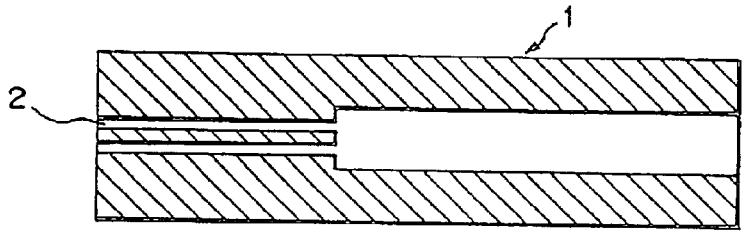
FIG. 2
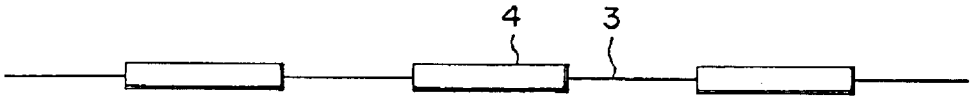

METHOD OF MANUFACTURING PART FOR OPTICAL FIBER CONNECTOR

BACKGROUND OF THE INVENTION

The present invention relates to a method of manufacturing a part for an optical fiber connector, and more specifically to a method of manufacturing a part generally called a ferrule that comprises some components and supports an optical fiber positioned in the center of the ferrule. The optical fiber connector connects optical fibers each having a perfect circular cross-section and a diameter of 0.125 mm by passing the optical fibers through a cylindrical-shaped tube to support them, so that the positions of cores positioned in the center of the optical fibers are accurately adjusted to each other.

A ferrule, which is conventionally one of parts for an optical fiber connector, has a shape shown in FIGS. 1(*a*) and 1(*b*), and the material of the ferrule principally includes one that uses zirconia ceramic. FIG. 1(*a*) shows a one-core type ferrule 1 with a cylindrical shape having a diameter of about 2 mm and a length of about 8 mm, and in the center of the circular shape of the ferrule 1 a perfect circular hole 2 of 0.126 mmϕ is drilled. FIG. 1(*b*) shows a two-core type ferrule 1.

Meanwhile, the present inventor has been proposed in Japanese Patent Unexamined Publication No. Hei. 10-375372 a metallic ferrule made of nickel or the like by electroforming using a metallic or ceramic wire as a mother mold.

In the invention of the above-mentioned patent publication, a method comprising the steps of electroforming on a wire such as a metallic wire or the like used as a mother mold, and drawing the wire is a predominant method. However, since the method is not used for drawing the wire to a longer one, a drawing method has been proposed in which after sealing a wire 3 at regular intervals by electric insulators 4 such as vinyl tapes as shown in FIG. 2, electroforming is performed using the wire as a mother mold, then the insulators 4 are peeled to be in a state where the wire 3 extends from the electroformed portion 5 as shown in FIG. 3, and after setting the electroformed portion 5 on a drawing jig 6, the wire 3 clamped is drawn out.

More specifically, in the drawing method comprising the steps of using a wire such as a metallic wire or the like as a mother mold, and drawing the wire after electroforming on the mother mold wire, since the tensile strength of the wire is insufficient and the drawing resistance is high, the drawing is performed only to a length of about 30 to 100 mm of the length. To make the electroformed portion 5 into a rod as long as possible is very important for an improvement in productivity of the electroforming. As a result, the method using electric insulators was reluctantly adopted. However, the following problems arose.

When electroforming is performed applying an electrode from above using, for example, a stainless steel wire as a mother mold, the conductivity of the stainless steel wire is not good and electric current does not flow sufficiently to an electric insulator seal portion (portion not electroformed). Thus, there occurs the phenomenon that the upper and lower portions significantly tend to be thickened and thinned, respectively.

Thus, electric precipitation must be continued till a size of thinnest portion is changed to a desired size. As a result, there were wastes of electricity, time and electroformed metal.

Further, there were problems that since variations in the diameter of the obtained electroformed article were very large, a step of aligning the diameters of the electroformed articles by NC lathe working or the like must be added in the next machining step, or this aligning step tended to cause a failure such as an off-centered hole or the like.

On the other hand, since a step of sealing the wire with an electric insulator is carried out by a manual operation, a large amount of time is required, and if the electric insulator is not fixed sufficiently, a number of problems occur; the electric insulator such as a tape or the like shifts during the electroforming to a cause a failure and the like. Thus, conventional methods impede mass production in cost and quality.

Taking the above-mentioned problems into consideration, in a method of manufacturing a ferrule wherein electroforming is carried out using a wire such as a metallic wire or the like as a mother mold, and after drawing the wire, machining the obtained electroformed article, the object of the present invention is to provide a method by which an electroformed article having the longest possible length and a small variation in the size of diameters without the step of sealing an electric insulator.

SUMMARY OF THE INVENTION

To solve the above-described problems, the present invention adopts a method comprising the steps of electroforming a portion to be electroformed to form one elongated rod as shown in FIG. 5(*a*), cutting the circumferential surface of the rod to form grooves 7 thereon as shown in FIG. 5(*b*), breaking the groove portion and drawing the wire 3. Further, the method comprises machining the electroformed rod to adjust at least the length and size (diameter) of the rod.

It is noted that the rod may be machined to adjust the roundness and the linearity of the rod in addition to the length and diameter as required.

BRIEF DESCRIPTION OF THE DRAWINGS

FIG. 1(*a*) (1) is a cross-sectional view of a part for an optical fiber connector according to a conventional method;

FIG. 1(*a*)(2) is a side elevational view of the optical fiber connector of FIG. 1(*a*)(1);

FIG. 1(*b*)(1) is a cross-sectional view of a part for an optical fiber connector according to another conventional method;

FIG. 1(*b*) (2) is a side elevational view of the optical fiber connector of FIG. 1(*b*)(1);

FIG. 2 is a side view showing an example of a setting method for electroforming metal in a case where a wire is drawn by a conventional drawing method;

FIG. 7(*b*) is a plan view of the supporting jig of FIG. 7(*a*); and

DETAILED DESCRIPTION OF THE INVENTION

The above-described general configuration will be described more specifically.

Figure 6:
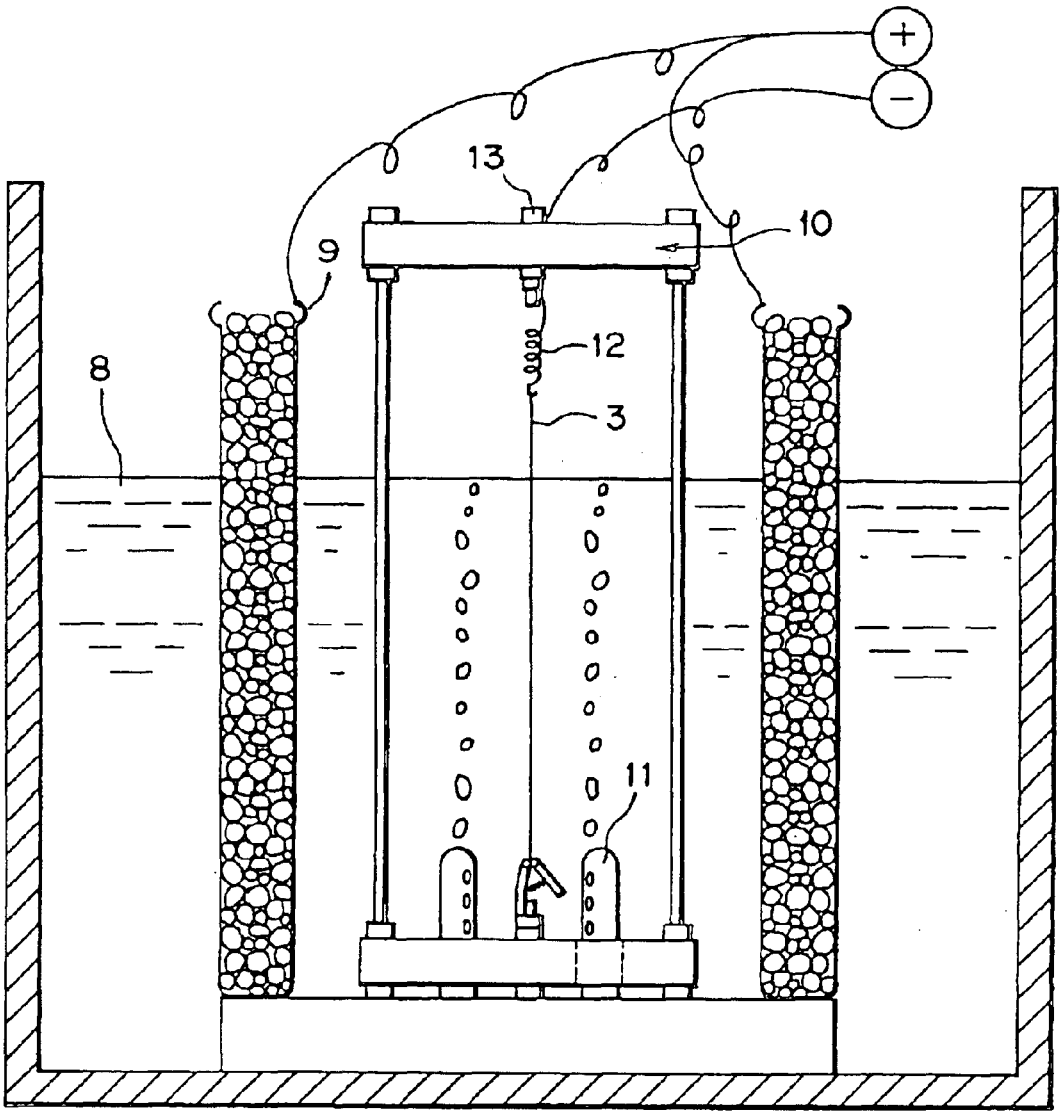
FIG. 6 is a schematic configuration view showing one example of an electroforming manufacturing device according to the present invention.

An electroforming device is schematically shown in FIG. 6. In FIG. 6, the electroforming device comprises an electroforming liquid 8, a positive electrode 9, a supporting jig 10, an air stirring nozzle 11, a spring 12, a negative electrode 13, and a wire 3.

The electroforming liquid 8 varies depending on the material of aimed metals to be electroformed. The metals to be electroformed can include, for example, nickel or its alloy, iron or its alloy, copper or its alloy, cobalt or its alloy, tungsten alloy, and fine particles dispersed alloy, and the like. Further, aqueous solutions containing an aqueous solution as a principal component such as nickel sulfamate, nickel chloride, nickel sulfate, ferrous sulfamate, ferrous borofluoride, copper pyrophosphate, copper sulfate, copper borofluoride, copper silicofluoride, copper titanium fluoride, alkanol copper sulfonate, cobalt sulfate, sodium tungstate or the like, and solutions obtained by dispersing fine particles such as silicon carbide, tungsten carbide, boron carbide, zirconium oxide, silicon nitride, alumina, diamond or the like into the above-mentioned aqueous solutions are used. Of these aqueous solutions, particularly, an aqueous solution containing nickel sulfamate as a principal component is suitable from the viewpoint of easiness in electroforming, variety in properties such as hardness and the like, chemical stability, easiness in welding, and the like. Further, it is preferable that the electroforming liquid is filtered at a high speed with a filter having a filtration accuracy, it is then heated and temperature-controlled to a temperature within an appropriate temperature range of about ±5° C., organic impurities are removed by activated carbon processing, and metal impurities such as copper and the like are also removed by setting a nickel plated corrugated iron sheet as an anode and a carbon plate as a cathode to energize therebetween at a low current density of about 0.2 $A/dm^2$.

The positive electrodes 9 vary depending on the aimed metal to be electroformed, and are selected from nickel, iron, copper, cobalt or the like. Sheet or spherical positive electrode is appropriately used. When the spherical plus electrodes are used, they may be used in a state where the electrodes are placed into a titanium basket and covered with a polyester bag. Four positive electrodes are arranged around the wire 3 positioned at the center of the electrodes.

Figure 7A:
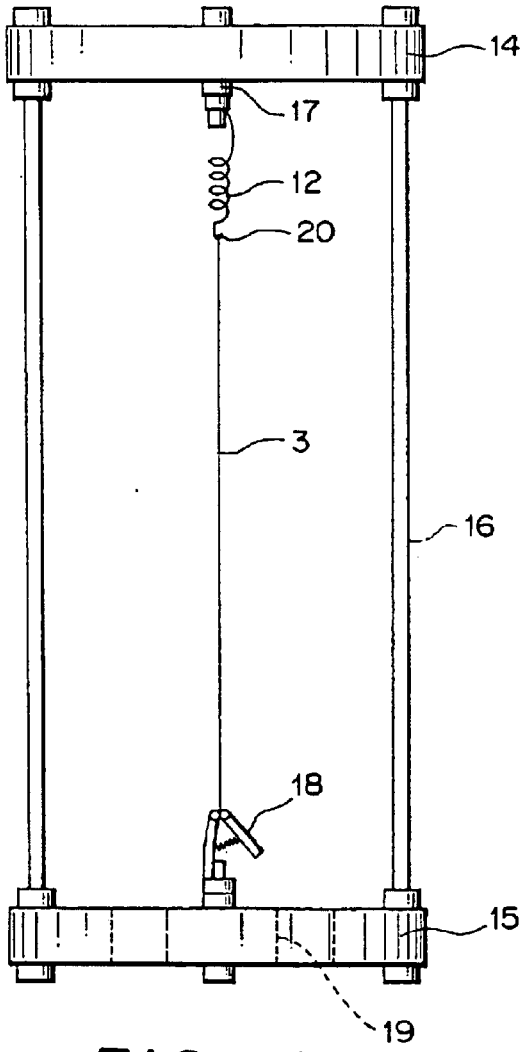
FIG. 7(*a*) is a side view showing one example of a supporting jig according to the present invention.
Figure 7B:
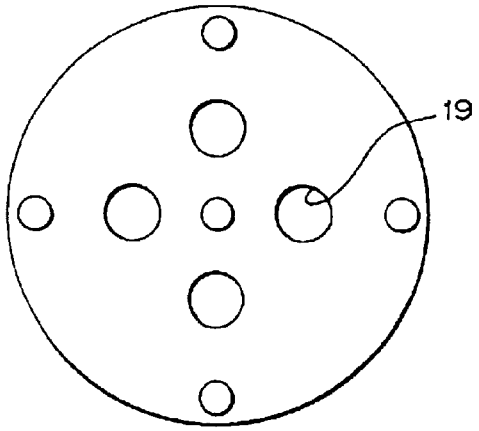
Figure 8A:
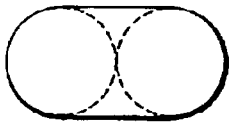
FIGS. 8(*a*) to 8(*g*) are cross-sectional views showing a multi-core shape wire other than a circular shape, according to the present invention.
Figure 8B:
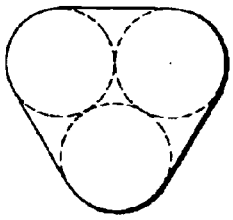
Figure 8C:
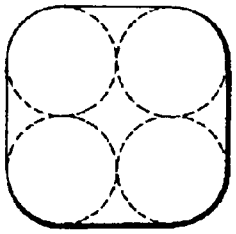
Figure 8D:
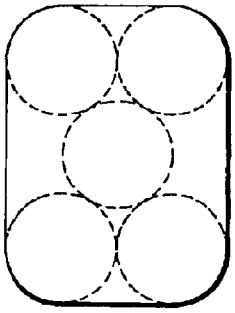
Figure 8E:
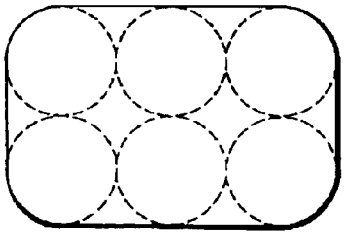
Figure 8F:
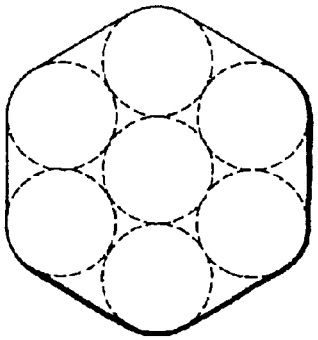
Figure 8G:
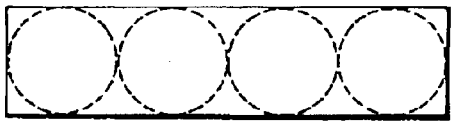

In the case of an one-core type, the supporting jig 10 is configured in such a manner that the upper plate 14 and the lower plate 15 are fixed to four supporting columns 16, as shown in FIG. 7(*a*), for example. The upper plate 14 and the lower plate 15 each use an electric insulating material such as polyvinyl chloride, polyamide resin, polyacetal resin, polyethylene resin or the like. The supporting column 16 uses a metal such as stainless steel, titanium or the like, or plastics. The upper plate 14 and the lower plate 15 are fixed to the supporting column 16 by screws. To the center of the upper plate 14 is fixed a stainless steel spring 12 with a stainless steel screw 17. Further, to the center of the lower plate 15 is fixed a plastic clip 18 with a screw, and in the lower plate 15 four circular nozzles 19 for air nozzles are provided. The wire 3 is first secured on a hook portion 20 of the stainless steel spring 12, the wire 3 is drawn and it is fastened with the clip 18 while stretching the spring 12 whereby the stretched wire 3 becomes straight.

Alternatively, in the case of two- or multi-core type, high accuracy is required as described above. Thus, a wire having a cross-sectional shape other than a circular cross-section may be used as shown in FIGS. 8(*a*) to 8(*g*). That is, in FIG. 8, the shape of (a) is an oval wire, which is a two-core type, the shape of (b) is a triangular wire with a round portion in each corner, which is a three-core type, the share of (c) is a square wire with a round portion in each corner, which is a four-core type, the shape of (d) is a rectangular wire with a round portion in each corner, which is a five-core type, the shape of (e) is a rectangular wire with a round portion in each corner, which is a six-core type, the shape of (f) is a hexagonal wire with a round portion in each corner, which is a seven-core type, and the shape of (g) is a rectangular wire with a four-core type. However, in FIGS. 8(*a*) to 8(*f*), round portions may not be provided in corners. When these wire's are used, the same method as in the case of a one-core type can be utilized.

Then, a small amount of air is emitted from holes of the air stirring or blowing nozzles 11 to stir the liquid 8. However, this stirring is not limited to the air stirring and may use stirring by a propeller, an ultrasonic vibration or the like.

The wire 3 is appropriately selected from a metallic wire such as iron or its alloy, copper or its alloy, or the like, and a thin low-melting point metal plated metallic wire (the metallic wire mentioned above) and a plastic wire such as nylon, polyester, and Teflon, and used. However, the stainless steel wire is preferable due to a high tensile strength, long stability of the wire and the like. Of the above-mentioned wires, the plastic wire needs electroless plating such as nickel, silver or the like to impart conductivity to the surface of the wire. The wire 3 requires high precision in size (diameter), roundness, and linearity. Thus, the adjustment of size (diameter), roundness of the cross-section and linearity may be performed by a drawing/extrusion method or wire drawing using dies or the like. In the case of a multi-core type wire having a cross-section other than a circle, a proper size can be obtained by drawing/extrusion method with dies.

Electroforming is carried out by the above-mentioned device. In this example, the electroforming is carried out at a current density of about 4 to 8 $A/dm^2$ for 20 hours, so that one elongated rod-shaped portion having a diameter of 2 to 3 mm is obtained by the growth of electroforming portion, and the electroformed rod is removed from the electroforming tank, rinsed well and dried.

Figure 3:
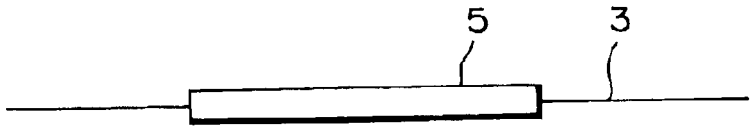
FIG. 3 is a side view of an electroformed article in a case where a wire is drawn by a conventional drawing method.
Figure 4:
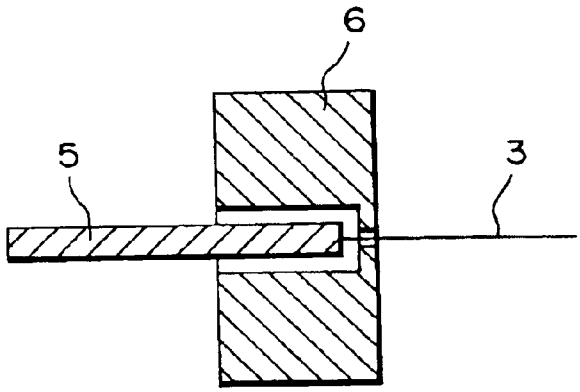
FIG. 4 is a cross-sectional view showing one example of a method of drawing a wire from the electroformed article in a case where a wire is drawn by a conventional drawing method.
Figure 5A:
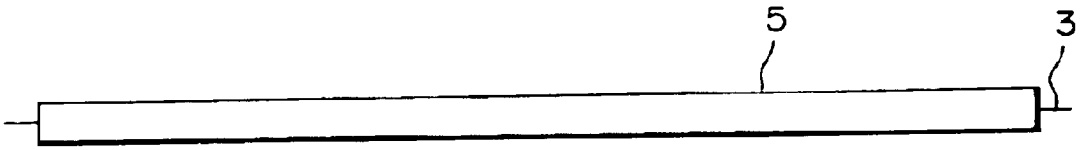
FIG. 5(*a*) and FIG. 5(*b*) are side views showing the shapes before and after cutting grooves on the surface of an electroformed article according to the present invention.
Figure 5B:
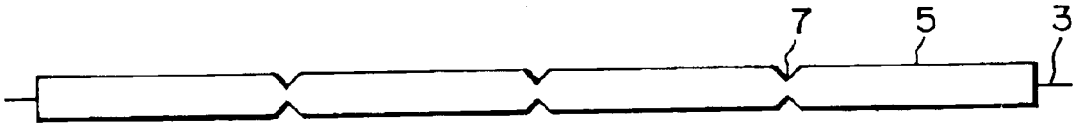

Next, grooves 7 are formed by cutting the circumferential surface of the electroformed rod at intervals of about 30 to 80 mm using a lathe or grinder so that the wire portions, which pass through the center of the electroformed rod, are left, as shown in FIG. 5(*b*). After that if the portions of the grooves 7 are bent, only the electroformed portions are broken and the wire is not broken since the electroformed portions are brittle and the wire is strong. Accordingly, the wire can be easily drawn. The groove 7 is preferably provided on the entire circumference of the surface of the electroformed rod while having a V-shaped cross-section of the groove. However, the cross-section of the groove is not limited particularly, and the groove may be partially provided without providing it on the entire circumference of the surface of the electroformed rod. Further, in the case of the low melting point alloy plated metallic wire, the rod portion is broken and the wire may be drawn out while it is heated.

In a method comprising electroforming on a metallic wire or the like used as a mother mold, and drawing the wire, the method of the present invention adopts a method comprising electroforming on the wire to make the wire one elongated rod, cutting the circumferential surface of the electroformed rod to provide grooves thereon, and breaking the groove portion and drawing the wire. Thus, according to the present invention, the use of an electric insulator can be omitted, and elongated electroformed portion can be obtained while the variation in diameter can be decreased.

Embodiment

An example of the present invention will be described below. A SUS 304 wire having a circular cross-section and a diameter of 0.126 nun was prepared, and the wire was set at an electroforming jig with the wire stretched by the elasticity of a spring as shown in FIG. 6. After rinsing the wire, the wire was electrolytically degreased and rinsed. After the wire was immersed in an aqueous solution of Nikka Non-tack A and B mixed liquid produced by Nippon Chemical Industry Co. Ltd., at an ordinary room temperature for 10 minutes and mold releasing processing was performed. After that the wire was rinsed well. On the other hand, the following tank was prepared. That is, four anodes of nickel spheres in titanium net contained in a polyester bag were provided in an electroforming liquid principally containing nickel sulfamate and in the four corners of the tank. The wire was placed substantially at the center of the four anodes. The electroforming liquid was filtered with 1 $\mu$m filtration precision at high speed and heated the tank at 50±20° C. Then, they were set as shown in FIG. 6, and the wire was used as a cathode and nickel spheres were used as anodes. Electroforming was performed one day at a current density of about 4 to 6 A/dm$^2$ and a nickel electroformed article (rod) having an average diameter of 2.5 mm and a length of about 250 mm resulted. Then, cutting grooves were prepared on the surface of the electroformed article at intervals of about 50 mm with a polishing machine. This groove portion was bent and broken and the wire was easily drawn. Then, the electroformed article was machined or ground to a diameter of 2.00 nun and a length of 8.00 mm with an NC . auto-turning machine, a centerless machine or the like to obtain a finished product. The products manufactured this way were problem free.

Effect of the Invention

The present invention has the following effects by the above-described method. By a method comprising electroforming on a metallic wire used as a mother mold, and drawing the wire, the present invention adopted a method comprising electroforming on the wire to make the wire into one elongated electroformed rod, providing grooves on the circumferential surface of the rod by cutting the portion, breaking the groove portion and drawing the wire. Therefore, the sealing step using an insulator or the like, which conventionally required a long time and a considerable effort, and often generating a failure, can be omitted.

Further, an elongated electroformed article (rod) longer than a conventional one can be obtained, and the variation of diameters of the rod is significantly decreased. Thus, wastes of electricity, time and metal such as nickel required for continuing the electrolytic precipitation until the thinnest portion becomes a predetermined diameter, can be reduced.

Further, since the variation of the diameters of the rod can be significantly reduced, machining, which is the next step, is very easy, and the rate of failure such as an off-centered failure is reduced, whereby a significant improvement of productivity and quality can be realized.

1 Ferrule
2 Perfect circle
3 Wire
4 Electric insulator
5 Electroformed portion
6 Drawing jig
7 Groove
8 Electroforming liquid
9 Positive electrode
10 Supporting jig
11 Air stirring nozzle
12 Spring
13 Negative electrode
14 Upper plate
15 Lower plate
16 Supporting column
17 Stainless steel screw
18 Clip
19 Circular hole
20 Hook portion

What is claimed is:

1. A method of manufacturing a part for an optical fiber connector, the method comprising the steps of:

electroforming a metal on a wire used as a mother mold with the wire stretched to make the wire into a rod-shaped portion formed by the electroformed metal, forming grooves of V-shaped cross-section by using one of a lathe or grinder such that portions of the wire remain on the rod-shaped portion formed by the electroformed metal at intervals to form groove portions, breaking the groove portions, drawing the wire, and machining the rod-shaped portion formed by the electroformed metal to adjust at least a length and diameter of the rod.

2. The method of manufacturing a part for an optical fiber connector according to claim 1, wherein one wire is used.

3. The method of manufacturing a part for an optical fiber connector according to claim 1, wherein a plurality of wires are used.

4. The method of manufacturing a part for an optical fiber connector according to claim 1, wherein the step of electroforming includes the step of electroforming a metal on a wire having a multi-core shape using cross-sections of the wire other than a circular cross-section.

5. The method of manufacturing a part for an optical fiber connector according to claim 1, wherein the wire is made from metal.

6. The method of manufacturing a part for an optical fiber connector according to claim 1, wherein the wire is made from plastic.

* * * * *